US006824177B1

(12) United States Patent
Nass et al.

(10) Patent No.: US 6,824,177 B1
(45) Date of Patent: Nov. 30, 2004

(54) LOCKING SYSTEM FOR THE DOOR OF A MOTOR VEHICLE

(75) Inventors: Ulrich Nass, Múlheim (DE); Alexander Buschmann, Mettmann (DE); Andreas Beck, Bochum (DE); Dominik Scholz, Krefeld (DE); Horst Brackmann, Velbert (DE)

(73) Assignee: Kiekert AG, Heiligenhaus (DE)

( * ) Notice: Subject to any disclaimer, the term of this patent is extended or adjusted under 35 U.S.C. 154(b) by 43 days.

(21) Appl. No.: 10/111,945

(22) PCT Filed: Oct. 25, 2000

(86) PCT No.: PCT/EP00/10481

§ 371 (c)(1),
(2), (4) Date: Nov. 20, 2002

(87) PCT Pub. No.: WO01/33017

PCT Pub. Date: May 10, 2001

(30) Foreign Application Priority Data

Oct. 29, 1999 (DE) ..... 199 52 411
Jan. 15, 2000 (DE) ..... 100 01 435

(51) Int. Cl.[7] ..... E05C 3/06
(52) U.S. Cl. ..... 292/216; 292/201; 292/DIG. 23
(58) Field of Search ..... 292/216, 201, 292/DIG. 23

(56) References Cited

U.S. PATENT DOCUMENTS 3,386,761 A * 6/1968 Johnstone et al. ..... 292/201
3,504,511 A * 4/1970 Allen ..... 70/241
RE27,390 E * 6/1972 Allen ..... 292/201
4,569,544 A * 2/1986 Escaravage ..... 292/216
4,802,350 A * 2/1989 Periou ..... 70/264
4,904,006 A * 2/1990 Hayakawa et al. ..... 292/336.3
4,974,886 A * 12/1990 Kleefeldt et al. ..... 292/201
5,066,054 A * 11/1991 Ingenhoven ..... 292/201
5,078,436 A * 1/1992 Kleefeldt et al. ..... 292/201
5,134,392 A 7/1992 Takeuchi et al.
5,238,274 A * 8/1993 Becker et al. ..... 292/201
5,419,597 A * 5/1995 Brackmann et al. ..... 292/201
5,474,338 A * 12/1995 Buscher ..... 292/201
5,762,384 A * 6/1998 Bartel ..... 292/216
5,921,595 A * 7/1999 Brackmann et al. ..... 292/216
5,961,163 A * 10/1999 Brackmann et al. ..... 292/201

FOREIGN PATENT DOCUMENTS

| | | |
|---|---|---|
| DE | 38 20 248 | 1/1989 |
| DE | 196 27 246 | 1/1997 |
| DE | 196 32 781 | 2/1998 |
| DE | 196 50 826 | 6/1998 |
| DE | 199 34 128 | 1/2001 |

* cited by examiner

*Primary Examiner*—Daniel P. Stodola
*Assistant Examiner*—Carlos Lugo
(74) *Attorney, Agent, or Firm*—Herbert Dubno; Andrew Wilford

(57) ABSTRACT

A motor-vehicle door latch has a latch mechanism, a locking lever movable between a locked position and an unlocked position, a motor drive, and a blocking lever engageable with the locking lever. The locking lever can be decoupled from the blocking lever during fast unlocking so that the locking lever can move into its unlocked position. A spring-loaded force-transmitting lever is coupled to the drive so as to, when displaced thereby in one direction, entrain the locking lever for fast unlocking and so as to, when displaced by the drive in an opposite direction, deflect.

9 Claims, 6 Drawing Sheets

LOCKING SYSTEM FOR THE DOOR OF A MOTOR VEHICLE

The invention relates to a motor-vehicle door latch with a latching mechanism formed as a standard pivotal bolt and a latching pawl engaging it, and further with at least one locking lever, preferably a central locking lever, and with at least one (electric) motor drive. In addition at least one actuating lever for operation from inside and/or outside can be provided.

A motor-vehicle door latch of the above-described type is for example known through German published application 196 27 246. Here a device for fast unlocking of the door latch is also described. Preferably it is constituted by a solenoid which moves between an extra-security (antitheft-on) position and an unlocked position. In the unlocked position the latching pawl and the release lever coact such that on actuation of the (outside) actuating lever the pawl is lifted off the pivotal bolt and the respective motor-vehicle door can be opened.

The above-described motor-vehicle door latch has proven effective in practice, but requires on the one hand the described and specially manufactured solenoid and on the other hand a separate and independent central-locking drive. This is expensive.

In addition for some time motor-vehicles are known to have so-called keyless entry systems that allow entry into the vehicle without the use of the otherwise standard mechanical key. A keyless entry system functions in that the vehicle user carries an identifying device (e.g. a code card) and on approaching the vehicle or when the outside actuator (door handle) is actuated, a transmitter/receiver system exchanges data between the identifying device and an on-board controller to determine (by comparing codes) if entry is authorized. If the necessary authorization is established, the electronic controller transmits signals to at least one of the door latches of the motor vehicle that is opened by an automatic motorized control element. Such a motor-vehicle door latch is for example described in German 3,820,248.

In case a door latch in motor vehicles is for example equipped with a keyless entry system, it is particularly necessary when additional use is made of an antitheft mechanism to reduce the time between triggering of the opening procedures and actual unlocking of the door (preferably less than 40 ms) such that the system is convenient to operate. This is significant because the motor-vehicle door latch must after receiving the door-unlock signal first move from the antitheft-on (extra-security) position and into the unlocked position. Here the central locking drive normally has an eccentric control pin and at least one fork seat and must execute two revolutions, so that there is a certain delay (see in this regard German 196 32 781). The invention proposes a solution to this problem.

It is a technical object of the invention to improve on a motor-vehicle door latch of the above-described type such that a relatively delay-free opening of the motor-vehicle door takes place with no particular extra construction cost.

This object is achieved by the invention in a motor-vehicle door latch of the described type wherein for fast unlocking a blocking lever is provided engaging the locking lever, preferably in its locked and/or antitheft-on position, the locking lever being separated from the locking lever by means of the (electric) motor drive during fast unlocking so that the locking lever can be moved into its unlocked position. This can be effected actively or passively. In the first case the blocking lever after fast unlocking is clear and can be shifted by its own setting member into the necessary unlocked position. Normally this is done in that the locking lever is moved during the fast unlocking automatically, preferably by a spring, into the unlocked position.

Also in the scope of the invention is a fast unlocking of the described motor-vehicle door latch. Fast unlocking means that the motor-vehicle door latch in general is moved directly from the antitheft-on, extra-security position or the locked position into the unlocked position. Thereafter the respective motor-vehicle door can be opened by operation of the actuating lever (or otherwise). Thus it is conceivable that the described actuating lever is actuated by an outside door handle so that the latch pawl is lifted off the pivotal bolt and then the door can be opened. Basically the fast unlocking can thus be followed by a conventional operation of the actual latch.

A motor-vehicle door latch can be any latch that serves not only for side doors but also for the trunk lid, tailgate, or hood, and even for the gas cap or the like. In addition it is without doubt within the scope of the invention to provide such a motor-vehicle door latch with additional devices for electrical opening, antitheft action, and infant security. Electrical opening in this case means that the latch pawl is moved out of engagement or latching connection with the pivotal bolt by means of an (electric) motor force.

In addition motor-vehicle door latches are included where access is mechanical, by means of a door key, door lock, and the respective door-lock nut or even by an electronic key (keyless entry). Of course in the last case the above-described data exchange takes place automatically or is triggered by the user via an actuatable remote controller (with its own transmitter).

According to a first alternative of the invention in order to have locked and antitheft functions or locked and antitheft positions, the locking lever has two seats. These seats are engageable with a nose on the blocking lever, as described in German patent application 199 34 128.1. In this regard more details are seen in the discussion of the drawing.

The two seats can be formed as part-circular pockets with different radial spacings from a rotation axis of the locking lever so that different positions of the blocking lever are achieved in the locked and antitheft positions. This is normally necessary to ensure that the actuating lever, for example in the locked position of the blocking lever, can lift out of the seat. On the other hand such a system is not usable in the antitheft-on position of the motor-vehicle door latch and is also not desired. In this position the actuating lever moves freely.

According to another alternative embodiment of the invention the locking lever has a pin working with the blocking lever. This pin engages in a pin seat on the blocking lever. In order to establish an antitheft-on position, in addition there is a (motor-actuated) antitheft lever. This antitheft lever can be moved during fast unlocking by means of the blocking lever from the antitheft-on to the antitheft-off position. Simultaneously the pin seat on the blocking lever is lifted off the pin on the locking lever so that this pin and its locking lever are freed. In this manner the already described motor drive serves to operate the blocking lever.

The blocking lever can cooperate with a spring-loaded force-transmitting lever that when operated by the motor drive entrains the locking lever for fast unlocking. This is most simply done in that the force-transmitting lever and the blocking lever are mounted on a common pivot axis and are usually at least partially overlapping and that the force-transmitting lever has for the necessary coupling an edge engaging the blocking lever during fast unlocking. In the opposite actuation direction (of the (electric) motor drive) the force-transmitting lever is deflected by this drive. This is necessary in order that the drive can according to the invention have an additional function, namely not only fast unlocking but also central locking.

According to a further alternative embodiment, the blocking lever has an elongated slot at which it is slidably pivoted and along which it is spring-biased. The (electric) motor drive for fast unlocking engages against an actuating edge of the blocking lever. The blocking lever is deflected via the slidable pivoting on opposite actuation movement of the (electric) motor drive (like what was described above) by movement along the slot.

In order to combine the various functions according to the invention, it is further suggested that the (electric) motor drive be used both for central locking (as well as if necessary for fast unlocking) and to this end has an electric motor with an output wheel or disk and an eccentric control bump. This control bump engages in at least one fork seat on the locking lever for (central) locking. Preferably two fork seats are provided, one for the locked position and one for the antitheft-on position (so long as no additional antitheft lever is employed).

Due to the double-duty of the (electric) motor drive the control bump also coacts not only with the force-transmitting lever and/or with the abutment edge of the blocking lever but additionally, as described, with the one or two fork seats on the locking lever.

As a result an extremely compact construction of the described motor-vehicle door latch is obtained that is particularly good for fast unlocking. In fact the output wheel engages with its control bump normally already after about a quarter turn with the blocking lever or its force-transmitting lever so that unwanted delay is excluded on fast opening of the motor-vehicle door latch. This is also the case when it has to be unlocked when in the antitheft-on position and when the unlocking signal is issued by the (central) locking system. In both cases one gets a nearly delay-free unlocking so that the attached motor-vehicle door can be opened immediately.

At the same time the (electric) motor drive takes over the function of moving the locking lever, in particular a central locking lever, into its locking position and/or antitheft-on position. As a result a further drive is not necessary, for a considerable cost advantage. Other features of the invention have a similar effect of setting the optional antitheft lever by means of a single (electric) motor drive. In spite of this basic possible one can also of course use an additional second drive.

The invention always has a particularly simple and clear construction. Here the principal advantages of the invention can be seen.

In the following the invention is described more closely with reference to a single embodiment. Therein:

Figure 1:
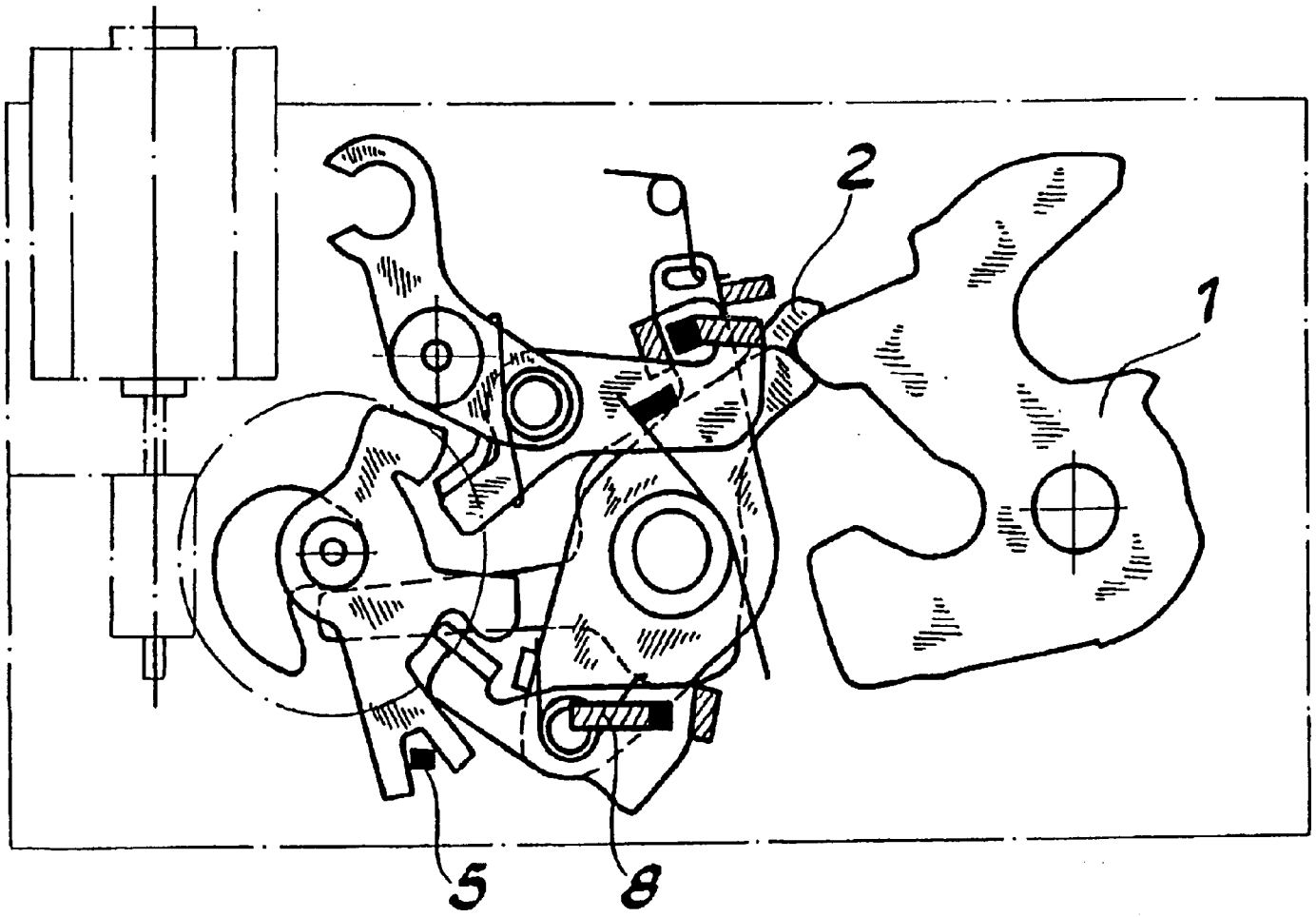
FIG. 1 is the latch mechanism belonging to the motor-vehicle door latch according to the invention which is shown at a right angle to the elements shown in the following figures.

In the figures a motor-vehicle door latch is shown which basically has a latching mechanism comprised of a pivotal bolt 1 and a latching pawl 2 effective on the pivotal bolt 1. Here the latching pawl 2 is operated purely mechanically. Of course the invention also includes electric-motor driven latching pawls 2 such as basically shown in published German patent document 196 50 826 (see FIG. 1). In addition the basic mechanism has an actuating-lever system with an actuating lever 3 for inside and/or outside actuation. This actuating lever 3 can be connected to an unillustrated actuating rod or an actuating bowden cable which leads as is known to an inside and/or outside door handle (see FIGS. 2 through 4).

There is an unillustrated key cylinder which is effective on a key nut 4. This key nut 4 serves in turn to pivot a locking lever 5, in this embodiment a central-locking lever 5. To this end the key nut 4 has an arm 6 that engages a corresponding arm 7 of the locking lever 5 and thus transmits its angular movement to the locking lever 5. These angular movements are shown in the figures by a double-arrow, V indicating a movement described below in detail into the locked position while E corresponds to pivoting into the unlocked position.

The locking lever/central-locking lever 5 cooperates with an inside locking lever 8 that, like the key cylinder with the key nut 4, serves for the necessary swinging or pivoting of the locking lever 5 into its locked, unlocked, and/or antitheft-on positions. There is also an electric-motor drive 9, 10, 11, and 12. This electric-motor drive 9, 10, 11, and 12 is comprised in this embodiment of an electric motor 9, an output shaft 10, and an output wheel or wheel 11 meshing with the shaft 10. This output wheel 11 has one (or more) eccentric cam bumps 12. The cam bumps 12 are shown in all figures in the starting position.

The electric motor 9 can rotate the output wheel 11 clockwise and counterclockwise which as shown in the drawing leads to the locked and unlocked positions (via a blocking lever 13). The antitheft-on position can also be set (see German patent application 199 34 128.1). Finally one can see this blocking lever 13, which serves for fast unlocking of the motor-vehicle door latch.

Figure 2:
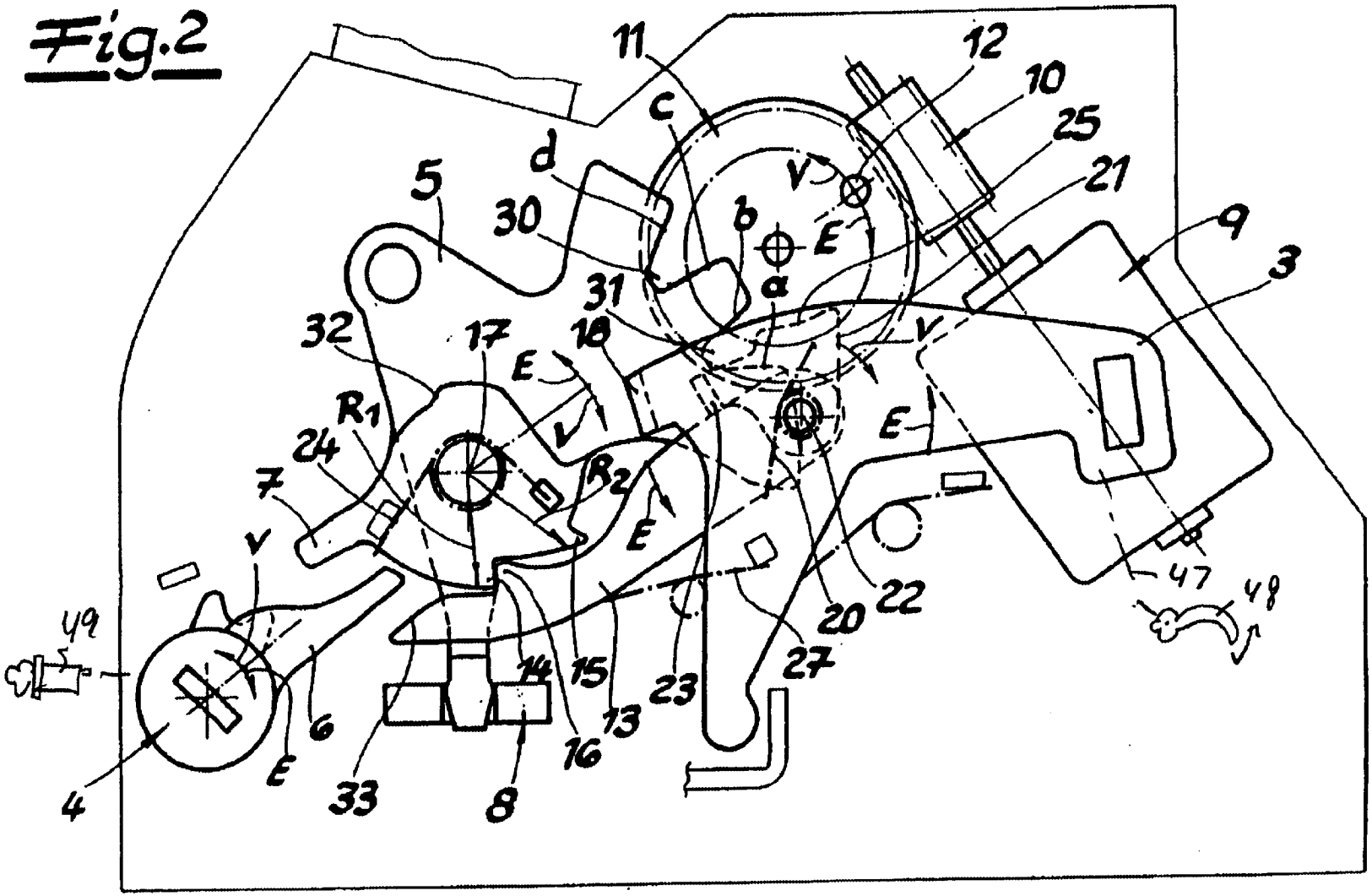
FIG. 2 is the motor-vehicle door latch according to the invention in a first embodiment in the locked position.
Figure 3:
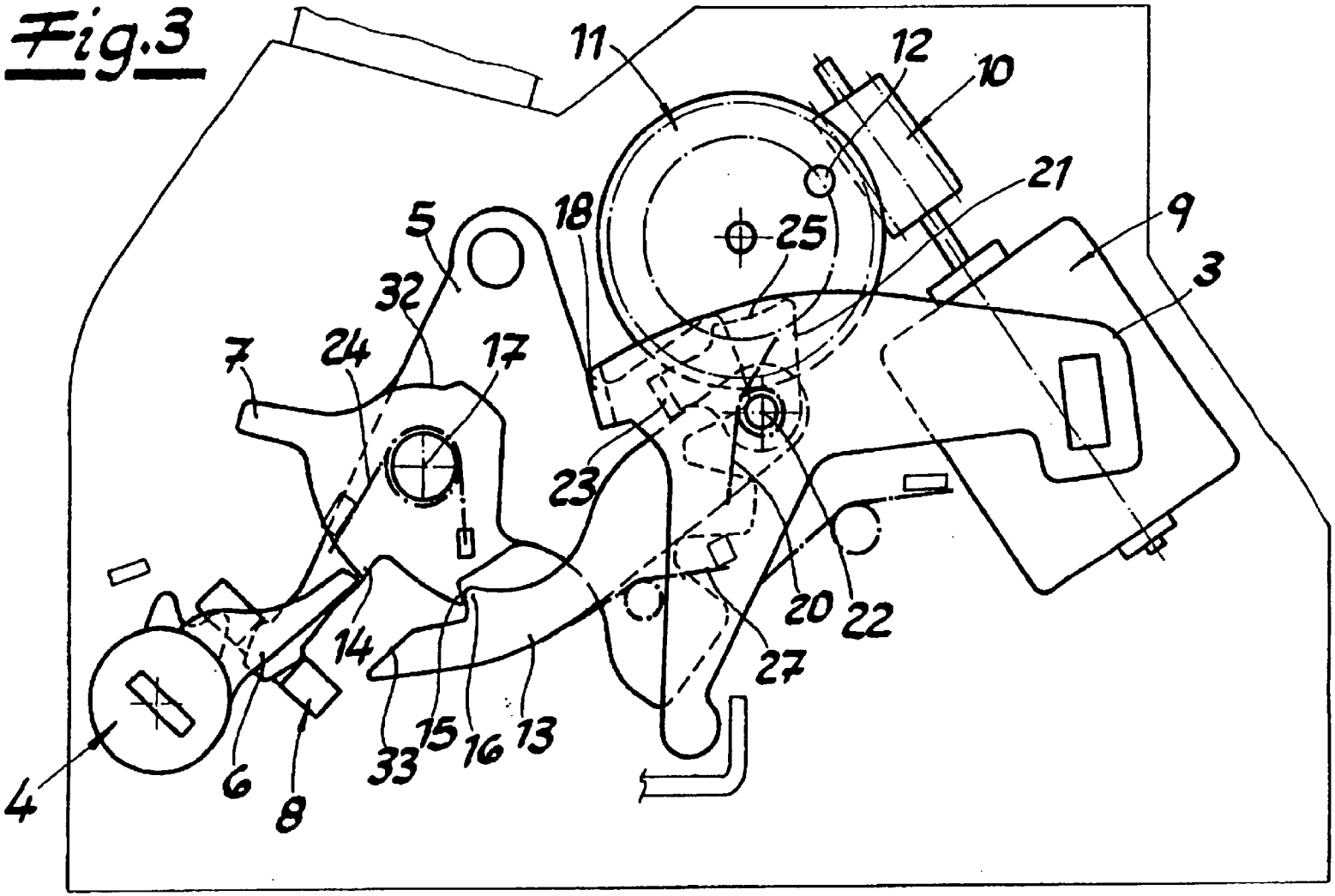
FIG. 3 is the motor-vehicle door latch according to FIG. 2 in the antitheft-on position.

This blocking lever 13 is constructed such that in this embodiment it is engaged with the locking lever 5 either in its locked position (see FIG. 2) or in its antitheft-on position (see FIG. 3). To this end the locking lever 5 has two seat notches 14 and 15 in which a nose 16 of the blocking lever 13 engages. If the nose 16 is in the seat notch 14, the locking lever 5 is in the locked position (see FIG. 2). If the nose 16 engages past into the seat notch 15, the antitheft-on position of the locking lever 5 is set (see FIG. 3). This is similar to what is described in above-cited German patent application 199 34 128.1 with the single difference that in this patent application other latch seats or latch elements are used (see the references 16 and 17).

The two seat notches 14 and 15 are circularly arcuate with different radial spacings $R_1$ and $R_2$ from a rotation axis 17 of the locking lever 5. In this embodiment $R_2>R_1$. Such a shape insures that in the antitheft-on position of the locking lever 5 the actuating lever 3 is clear of the movement stroke of an edge 18 of the blocking lever 13 (see FIG. 3).

In the locked position of the locking lever 5, the edge 18 is positioned to pivot the blocking lever 13 out of the seat notch 14 and move it into an unlocked position as shown by the arrow E at the contact point of the edge 18 in FIG. 2.

Figure 4:
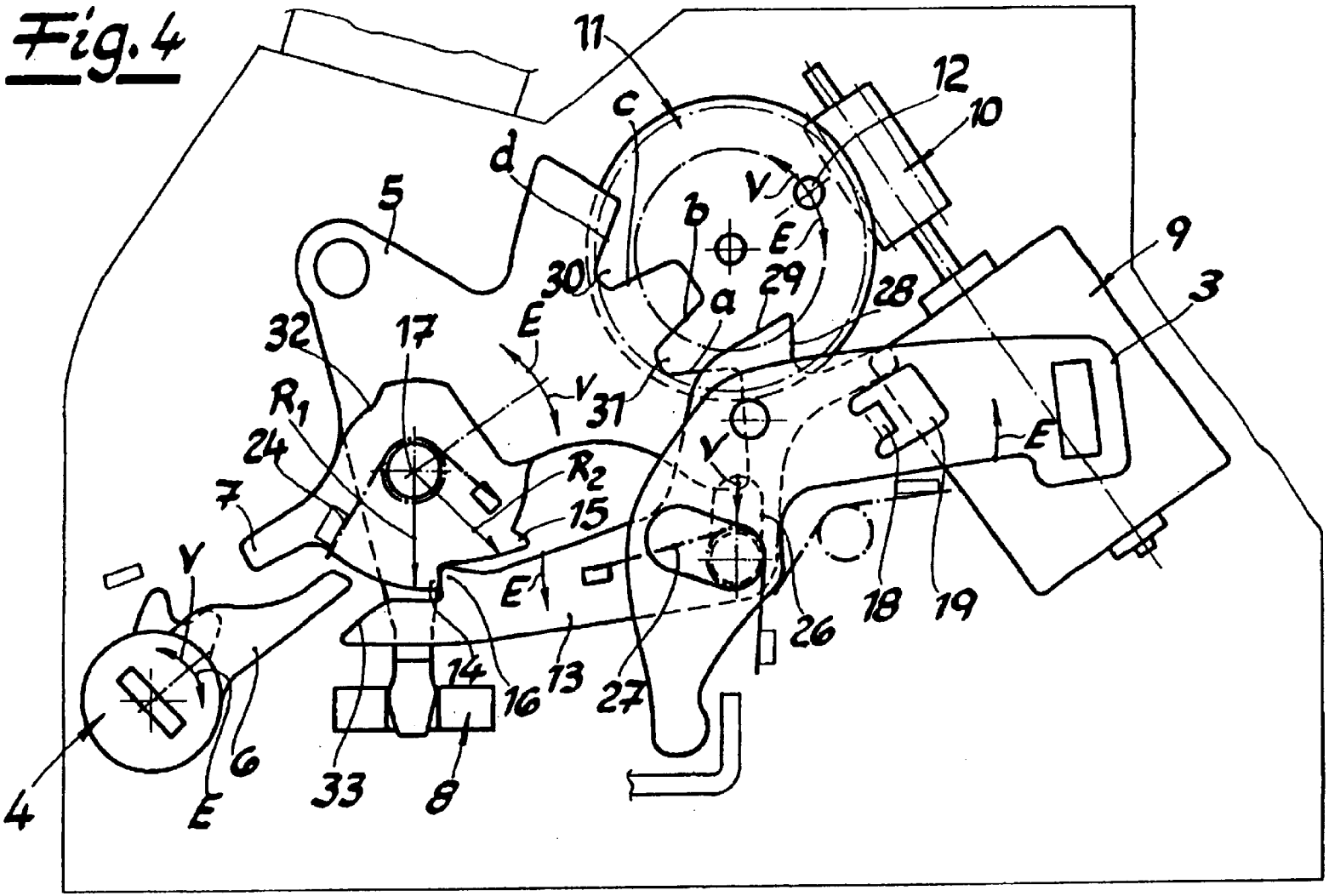
FIG. 4 is another embodiment of the motor-vehicle door latch according to FIGS. 2 and 3.

The same is true for the variant in FIG. 4 where the edge 18 is provided not at the outside edge but inward in a seat 19 on the actuating lever 3. In any case in the locked position of the locking lever 5 unlocking is made possible by the actuating lever 3 while this is not possible in the antitheft-on position so that the normal and desired functionality is provided.

Figure 5:
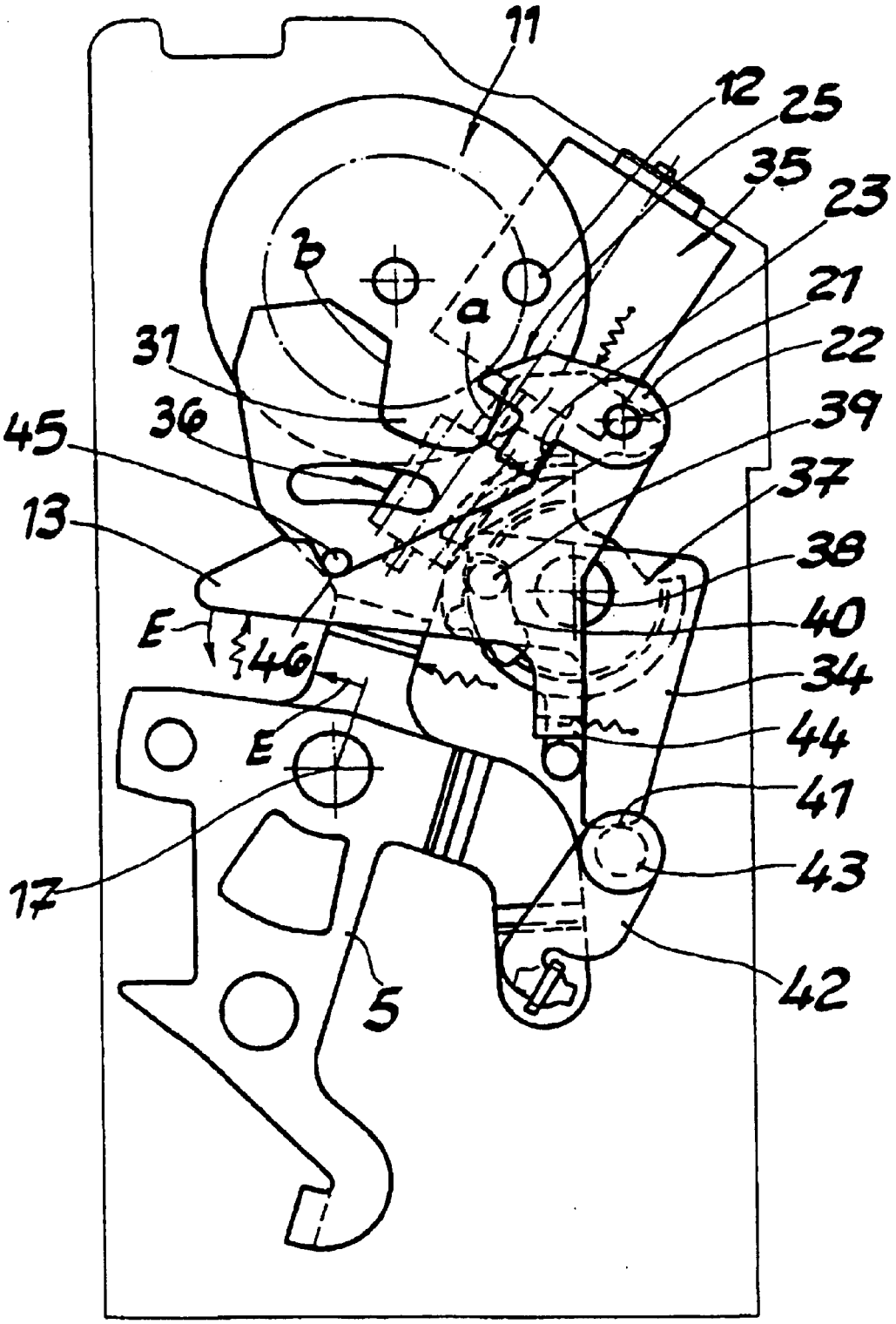
FIG. 5 is a further variant of the motor-vehicle door latch with antitheft lever in the antitheft-on position.
Figure 6:
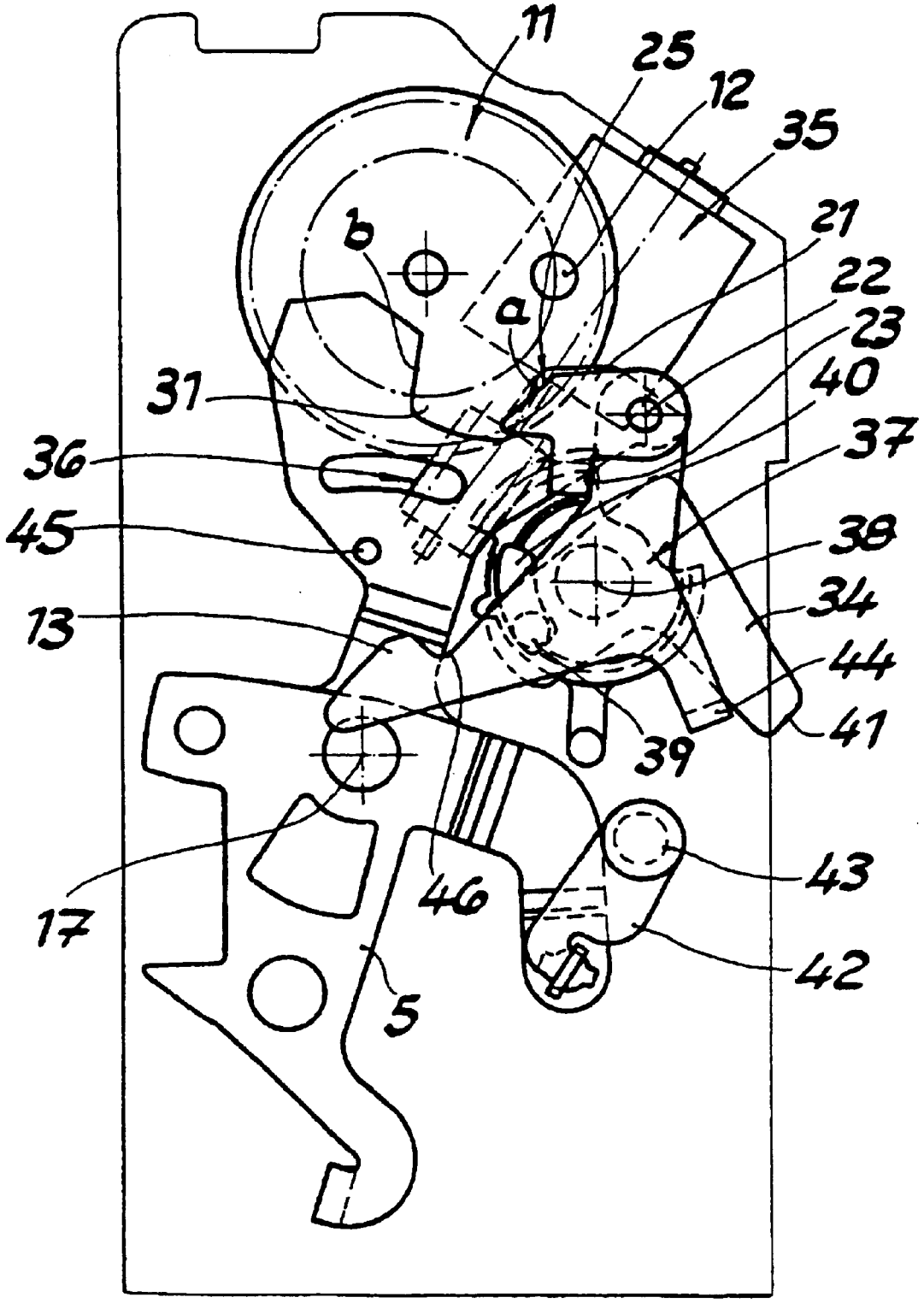
FIG. 6 is the motor-vehicle door latch according to FIG. 5 in the antitheft-off position.

In the embodiment of FIGS. 2 and 3 and that of FIGS. 5 and 6 a force-transmitting lever 21 biased by a spring 20 is provided on the blocking lever 13. When the output wheel 11 and thus the cam bump 12, driven by the motor 9, are rotated clockwise (the unlocking direction E), this cam bump 12 engages after about a quarter turn against the force-transmitting lever 21. Since the force-transmitting lever 21 and the blocking lever 13 lie in parallel planes and partially overlap and are pivotal about a common axis 22, this engagement of the cam bump 12 causes the force-transmitting lever 23 to entrain the blocking lever 13 with an edge 23. The blocking lever 13 thus turns counterclockwise as shown by the arrow in the unlocking direction E. Simultaneously for a fast unlocking the engagement nose 16 is pulled out of either of the notch seats 14 or 15 so that the locking lever 5 is now freed by the blocking lever 13.

Since the locking lever 5 is biased by a hairpin spring 24 in the unlocking direction E, the locking lever 5 will automatically shift into the unlocked position into engagement with an unillustrated abutment. This means that the motor-vehicle door latch can be opened by actuation of the actuating lever 3 which lifts the latch pawl 2 from the pivotal bolt 1.

When the output wheel 11 is moved counterclockwise in the latching direction V the already loaded spring 20 ensures that, starting from the FIG. 2 (and FIG. 5) position, the force-transmitting lever 21 is deflected against the spring force after about a three-quarter rotation of the control bump 12. Then the control bump 12 engages an edge 25 of this force-transmitting lever 21. As soon as the control bump 12 moves off of this edge 25 on its further movement counterclockwise, the force-transmitting lever 21 that was pivoted clockwise about the pivot axis 22 moves back and stops in the position shown in FIGS. 2, 3, 5, and 6 because its edge 23 engages the blocking lever 13 and further return pivoting of the force-transmitting lever 21 is blocked.

The variant according to FIG. 4 operates similarly. Here however there is no force-transmitting lever 21. Instead the blocking lever 13 has a slot 26 which allows axial shifting of the blocking lever 13. Normally the blocking lever 13 takes the position shown in the drawing because a further hairpin spring 27 is braced against it. Rotation of the control bump 12 through about 90° clockwise (a quarter turn) serves mainly to move the illustrated motor-vehicle door latch into the unlocked position E. The control bump 12 engages after moving through the corresponding arc against an abutment edge 28 of the blocking lever 13 so that the blocking lever 13 is turned counterclockwise and its nose 16 leaves the notch seat 14 or 15 with the corresponding effect on the locking lever 5.

When, however, the output wheel 11 is moved clockwise from the starting position of FIG. 4, after about a three-quarter revolution it reaches a further edge 29 of the blocking lever 13. Further movement of the control bump 12 pushes the blocking lever 13 downward or deflects the blocking lever 13 along the slot 26.

The locking lever 5 also has two fork seats 30 and 31 see FIGS. 2 and 4). These form four control surfaces a, b, c, and for the control pin 12 and function generally as described in German patent application 199 34 128.1 to which reference is made.

In particular actuation of the control surface a (fork seat 31) serves for locking of the motor-vehicle door latch with help of the control bump 12 as shown in FIG. 2. The antitheft-on position of FIG. 2 is assumed by actuation of the control surface c with the control bump coacting with the latching lever 4 by engaging in the fork seat 30 and pivoting the latching lever 4 clockwise until the blocking lever 13 snaps into the seat 15. The remaining control surfaces b and d serve for unlocking. This is not shown in this embodiment. Here the described fast unlocking is effected via the blocking lever 13 which is operated by the drive 9, 10, and 11 working with the control bump 12.

Furthermore this electric-motor drive 9, 10, 11, and 12 serves not only to set the locked position (see FIG. 2), and the antitheft-on position (see FIG. 3) of the locking lever 5 (via the control surfaces a and c) but also serves for the described fast unlocking via the blocking lever 13. It therefore serves two functions.

In order that the system operates as described, the arm 6 of the key nut 4 and the coacting arm 7 of the locking lever 5 are in one plane. The same is true for the seats 14 and 15. To this end the seats 14 and 15 and the arm 7 are formed by a raised part 32 of the locking lever 5. This part 32 and the locking lever 5 pivot jointly about the common axis 17. The spring 24 is below the described part 32 and the actual locking lever 5. The blocking lever 13 is in the same plane with the part 32 so that its nose 16 can coact in the described manner with the seats 14 and 15. The actuating lever 3 extends in the front down (or up) so that its edge 18 projects up (or down). This ensures that the projecting edge 18 can engage the overlying or underlying blocking lever 13 to release the latch mechanism 1, 2. Finally the control bump 12 of the output wheel 11 is generally level with the plane of the locking lever 5 so that the control bump 12 can engage in the fork seats 30 and 31 to have the described functions.

The actuation of the electric-motor drive 9, 10, 11, and 12 takes place in this embodiment for example when the electric motor 9 receives from an unillustrated controller the order "unlock door." This can take place with a keyless entry system after the necessary determination of the nearness of the vehicle user. Thereafter the described fast unlocking is effected by the control bump 12 moving clockwise and pivoting the blocking lever 13 counterclockwise to release the latching lever 4. If an outside door handle is operated during the described operations the motor-vehicle door opens immediately.

After unlocking of the door latch (which is monitored via unillustrated transmitters and sensors) the output wheel 11 is rotated counterclockwise into the starting position of FIGS. 2 through 6.

As visible in the illustrated embodiment the locking lever or central locking lever 5 is moved by the key nut 4, the electric-motor drive 9, 10, and 11 along with the control bump 12 or the inside locking lever 8 into the locked and/or antitheft-on positions. The nose 16 of the blocking lever 13 is urged by the spring 27 into the corresponding seat 14 or 15.

The unlocking (after a keyless-entry query) is effected by means of the described fast unlocking, that is by about a quarter clockwise rotation of the output wheel 11 with the control bump 12. Independently, the latching mechanism 1, 2 of the illustrated motor-vehicle door latch can be opened in the standard manner in that the actuating lever 3 engages with its edge 18 against the blocking lever 13 in the way known per se. Finally the arm 6 of the key nut 4 can serve for setting the unlocked and antitheft-off positions in that appropriate clockwise rotation of the nut 4 and engagement on an edge 33 of the blocking lever 13 frees the locking lever 5.

In any case fast unlocking requires only a quarter turn (or less) of the output wheel 11 so that the motor-vehicle door latch can be opened almost simultaneously on issuing of the necessary unlocking order for example via the already gripped outside door handle.

The locking and antitheft functions are handled by appropriate operation of the locking lever 5 by means of the key nut 4, the inside locking lever 8, or the electric-motor drive 9, 10, 11 together with the control bump. In the last case the output wheel 11 moves counterclockwise and in fact one or two rotations are completed. This sets the desired position of the locking lever 5 by engagement of the control bump in the appropriate fork seat 30 and/or 31. When the control bump 12 on orbiting counterclockwise reaches the force-transmitting lever 21 or the blocking lever 13, these are deflected out of the way as described.

The different embodiment of FIGS. 5 and 6 corresponds in its basic operation to the already described embodiments of FIGS. 1 to 4, so that reference can be made to that description. Here also the control bump 12 is always shown in its starting position. Unlike the system of FIGS. 2 to 4 with the two fork seats 30 and 31, here there is only one fork seat 31 with the control surfaces and b. The respective locking lever 5 is moved with the aid of the control surface a into its locked position as shown in FIG. 5.

An antitheft-on position of the locking lever 5 is taken care of by an additionally provided antitheft lever 34. This antitheft lever 34 is provided with a (dedicated) motor drive 35, 36. Of course it would be possible here to use the already described drive 9, 10, 11, and 12. By means of this additional drive 35, 36, 37 the antitheft lever 34 can be moved between the antitheft-on position (see FIG. 5) and antitheft-off position (see FIG. 6) by pivoting about an axis 38.

More particularly this is done in that a pin 39 projecting down from the antitheft lever 34 engages in an arcuate slot 40 of an underlying output disk 37 that meshes with a spindle 36 driven by an electric motor 35. Operation of the electric motor 35 is effective via the spindle 36 to rotate the output disk 37 and entrain the pin 39 of the antitheft lever 34 engaged in the arcuate slot 40.

In the antitheft-on position (see FIG. 5) pivoting of the locking lever 5 about its axis 17 is not transmitted to the latch mechanism 1, 2 because an edge 41 of the antitheft lever 34 decouples it. In other words a pin 43 of a connecting lever 42 working with the locking lever 5 is held out of engagement with the cited edge 41. The locking lever 5 can thus be moved in the unlocking direction E without the pin 43 of the connecting lever 42 following. In the antitheft off position (FIG. 6) on the other hand the pin 43 of the connecting lever 42 is free so that pivoting of the locking lever 5 about its axis 17 effects the desired unlocking of the latch mechanism 1, 2.

During fast unlocking the antitheft lever 34 is moved by the blocking lever 13 from its antitheft-on position to the antitheft-off position. This is done in this embodiment in that the blocking lever 13 with its edge 44 moves the antitheft lever 34 about its axis 83. Simultaneously the pin 39 moves counterclockwise in the arcuate slot 40 of the output disk 37.

Actuation of the blocking lever 13 is as described by means of the output wheel 11 working with the control pin 12 which after about a quarter turn, starting from the FIG. 5 illustrated position, engages the force-transmitting lever 21. For reasons of clarity the remaining parts of the already fully described motor drive 9, 10, 11, and 12, that is the electric motor 9 and the output shaft 10, are all that is shown in FIGS. 5 and 6.

Unrelated to the antitheft function, the locking lever 5 has a pin 45 engageable with the blocking lever 13, that is engageable in a pin seat 46 on the blocking lever 13. This engagement takes place automatically only in the case when the locking lever 5 is moved by the electric-motor drive 9, 10, 1, 12 into the locked position shown in FIGS. 5 and 6. In this case also only about a quarter turn of the output wheel 11 is needed in order to separate the blocking lever 13 by means of the control bump 12 engaging the force-transmitting lever 21 from the locking lever 5. This engagement of the control bump 12 on the force-transmitting lever 21 lifts the pin seat 46 from the pin 45 so that the locking lever 5 is moved by spring force into its unlocked position E (see arrow E in FIG. 6).

Simultaneously and independently the antitheft lever 34 in the antitheft-on position is entrained by the blocking lever 13 via its edge 44.

What is claimed is:

1. A motor-vehicle door latch comprising a latch mechanism;

a locking lever movable between a locked position and an unlocked position;

a motor drive;

a blocking lever engageable with the locking lever; and means connected to the drive for decoupling the locking lever from the blocking lever during fast unlocking so that the locking lever can move into its unlocked position; and a spring-loaded force-transmitting lever coupled to the drive so as to, when displaced thereby in one direction, entrain the locking lever for fast unlocking and so as to, when displaced by the drive in an opposite direction, deflect.

2. The motor-vehicle door latch according to claim 1 wherein the locking lever is moved during the fast unlocking automatically into the unlocked position.

3. The motor-vehicle door latch according to claim 1 wherein in order to have locked and antitheft-on positions, the locking lever has two seats which are engageable with a nose on the blocking lever.

4. The motor-vehicle door latch according to claim 3 wherein the two seats are part-circular pockets with different radial spacings from a rotation axis of the locking lever so that different positions of the blocking lever are achieved in the locked and antitheft-on positions.

5. The motor-vehicle door latch according to claim 1 wherein the locking lever has a pin working with the blocking lever.

6. The motor-vehicle door latch according to claim 5 wherein the pin engages in a pin seat on the blocking lever.

7. The motor-vehicle door latch according to claim 1 wherein in addition a preferably motor-actuated antitheft lever is provided that is moved during fast unlocking by means of the blocking lever from the antitheft-on to the antitheft-off position.

8. The motor-vehicle door latch according to claim 1 wherein the blocking lever has an elongated slot at which it is slidably pivoted and along which it is spring-biased, the motor drive for fast unlocking engaging against an actuating edge of the blocking lever, the blocking lever deflecting via the slidable pivoting on opposite actuation movement of the motor drive.

9. The motor-vehicle door latch according to claim 1 wherein the motor drive is used both for central locking as well as for fast unlocking and to this end has an electric motor with an output wheel and an eccentric control bump, the control bump engaging in at least one fork seat on the locking lever for locking and also coacting with the force-transmitting lever and/or the abutment edge of the blocking lever.

* * * * *